US010639918B2

(12) United States Patent
Hamada

(10) Patent No.: US 10,639,918 B2
(45) Date of Patent: May 5, 2020

(54) MEDIUM SUPPORT UNIT, PRINTING APPARATUS, AND METHOD OF ATTACHING COVER SECTION

(71) Applicant: SEIKO EPSON CORPORATION, Tokyo (JP)

(72) Inventor: Nobuhiko Hamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/152,453

(22) Filed: Oct. 5, 2018

(65) Prior Publication Data

US 2019/0105929 A1 Apr. 11, 2019

(30) Foreign Application Priority Data

Oct. 11, 2017 (JP) ..... 2017-197715

(51) Int. Cl.

| | |
|---|---|
| ***B41J 29/13*** | (2006.01) |
| ***B65H 11/00*** | (2006.01) |
| ***B41J 11/00*** | (2006.01) |
| ***B41J 11/06*** | (2006.01) |
| *B41J 3/407* | (2006.01) |

(52) U.S. Cl.

CPC ..... *B41J 29/13* (2013.01); *B41J 11/007* (2013.01); *B41J 11/06* (2013.01); *B65H 11/00* (2013.01); *B41J 3/4078* (2013.01)

(58) Field of Classification Search

CPC ..... B41J 11/06; B41J 11/13; B41J 3/4078

See application file for complete search history.

(56) References Cited

U.S. PATENT DOCUMENTS

| | | | | |
|---|---|---|---|---|
| 5,090,313 | A * | 2/1992 | Chapman | B41F 15/0863 101/115 |
| 5,513,922 | A * | 5/1996 | Umbach | B41J 3/46 347/222 |
| 5,800,614 | A * | 9/1998 | Foust | B05C 5/0275 118/315 |
| 7,458,174 | B1 * | 12/2008 | Gustin | D05C 1/02 38/102.2 |
| 7,681,510 | B2 * | 3/2010 | Watanabe | D05B 39/00 112/103 |
| 7,874,629 | B2 * | 1/2011 | Mizutani | B41J 11/06 347/104 |
| 2003/0197772 | A1 * | 10/2003 | Iwatsuki | B41J 3/4078 347/104 |

(Continued)

FOREIGN PATENT DOCUMENTS

JP 2004-291430 A 10/2004

*Primary Examiner* — John Zimmermann

(74) *Attorney, Agent, or Firm* — Workman Nydegger

(57) ABSTRACT

A medium support unit configured to support a medium on which printing is performed by a printing apparatus, the medium support unit including a support section including a support surface configured to support the medium, and a cover section to be attached to the support section to cover the support surface. The cover section includes, on at least a part of a front side, a friction member having a static friction coefficient with respect to the medium, which is greater than a static friction coefficient of the support surface, and on a back side, a first area having a first adhesive force and a second area whose adhesive force is less than the first adhesive force, the cover section is attached to the support section by adhering at least a part of the first area to the support section.

10 Claims, 12 Drawing Sheets

(56) References Cited

U.S. PATENT DOCUMENTS

| | | | | |
|---|---|---|---|---|
| 2004/0189776 | A1 | 9/2004 | Niimi et al. | |
| 2015/0151551 | A1* | 6/2015 | Livingston | B41J 3/4078 347/110 |
| 2016/0136978 | A1* | 5/2016 | Hamada | F16M 11/00 347/104 |

* cited by examiner

MEDIUM SUPPORT UNIT, PRINTING APPARATUS, AND METHOD OF ATTACHING COVER SECTION

BACKGROUND

1. Technical Field

The invention relates to a medium support unit, a printing apparatus, and a method of attaching a cover section.

2. Related Art

In the related art, printing apparatuses having various configurations have been used. Among such printing apparatuses, for example, printing apparatuses configured to perform printing on a medium supported by a support section are used. Among these printing apparatuses, a printing apparatus is used in which a friction member is adhered to a support section of a medium (a cover section including a friction member is adhered), and the support section supports a target recording medium by the frictional force of the friction member.

For example, in JP-A-2004-291430, an inkjet textile-printing apparatus (printing apparatus) is disclosed, which performs printing along with supporting a fabric (medium) by the frictional force of a cotton cloth (friction member) adhered to a platen (support section).

In a configuration where the friction member adheres to the support section of the medium, the friction member is occasionally replaced due to contamination or damage of the friction member. However, when an adhesive force for adhering the friction member to the support section is weakened, the friction member may unexpectedly be peeled off from the support section, while when the adhesive force for adhering the friction member to the support section is strengthened, replacing the friction member may be a burden.

For example, in the configuration disclosed in JP-A-2004-291430, there is no mention about an adhesive tape and disposal of an adhesive layer, and the like, in which the cotton cloth adheres to the platen, and when the adhesive force is weak, the cotton cloth may unexpectedly be peeled off from the platen, while when the adhesive force is strong, the burden of replacing the cotton cloth may become large.

Thus, the invention aims to facilitate the replacement of the friction member while preventing the friction member from being peeled off in a configuration where a friction member adheres to a support section that supports the medium.

SUMMARY

A medium support unit according to a first aspect of the invention for attaining the above-described objectives is a medium support unit configured to support a medium on which printing is performed by a printing apparatus, the medium support unit including a support section including a support surface on which a medium is supported, and a cover section attached to the support section to cover the support surface. The cover section includes, on at least a part of a front side on which the medium is supported, a friction member having a static friction coefficient with respect to the medium, which is greater than a static friction coefficient of the support surface, and on a back side opposite to the front side, which faces the support section when the cover section is attached to the support section, a first area having a first adhesive force and a second area whose adhesive force is less than the first adhesive force. The cover section is attached to the support section by adhering at least a part of the first area to the support section.

According to the present aspect, a first area having a first adhesive force and a second area whose adhesive force is less than the first adhesive force are provided on the back side of the cover section. Thus, the first area whose adhesive force relatively strong prevents the friction member (the cover section provided with the friction member) from being peeled off, and by the second area whose adhesive force relatively weak, the friction member is peeled off from the support section to facilitate the replacement of the friction member (the cover section provided with the friction member).

The medium support unit according to a second aspect of the invention includes, in the first aspect, at least a part of the second area disposed in a center portion of the back side of the cover section, and at least a part of the first area disposed outside of the center portion of the back side of the cover section.

According to the present aspect, the second area is disposed in the center portion and the first area is disposed outside of the center portion. Thus, positioning the support surface to coincide with the position of the second area is easily performed, for example, when the cover section is to be attached to the support section.

The medium support unit according to a third aspect of the invention includes, in the first or second aspect, at least a part of the first area disposed in the center portion of the back side of the cover section, and at least a part of the second area disposed outside of the center portion of the back side of the cover section.

According to the present aspect, the first area is disposed in the center portion and the second area is disposed outside of the center portion. Thus, for example, the friction member is peeled off from the support section from an outer portion, corresponding to the second area, as the starting point, to particularly facilitate the replacement of the cover section.

The medium support unit according to a fourth aspect of the invention includes, in any one of the first to third aspects, the second area including at least a weak adhesive area having a second adhesive force that is less than the first adhesive force.

According to the present aspect, the second area including at least the weak adhesive area prevents the friction member from being peeled off by means of the second area in addition to the first area, to effectively prevent the friction member from being peeled off.

The medium support unit according to a fifth aspect of the invention includes, in any one of the first to fourth aspects, the second area including at least a non-adhesive area having no adhesive force.

According to the present aspect, the second area includes at least the non-adhesive area. Thus, the friction member is particularly easily peeled off from the support section by means of the second area, to particularly facilitate the replacement of the cover section.

The medium support unit according to a sixth aspect of the invention includes, in any one of the first to fifth aspects, the cover section including a reinforcing member that makes the cover section hard to deform.

According to the present aspect, the cover section including the reinforcing member that makes the cover section hard to deform prevents the cover section from losing its shape when the cover section is to be attached to/detached from the support section.

The medium support unit according to a seventh aspect of the invention includes, in any one of the first to sixth aspects, the cover section including a handle section that is provided at a portion located outside of the support surface in a case where the cover section is attached to the support section.

According to the present aspect, the handle section is provided at the portion located outside of the support surface when the cover section is attached to the support section. Thus, when replacing the friction member (the cover section), the replacement of the cover section is made particularly easy by holding the handle section with fingertips.

A printing apparatus according to an eighth aspect of the invention includes the medium support unit according to any one of the first to seventh aspects, and a printing unit configured to perform printing on the medium supported by the medium support unit.

According to the present aspect, in the printing apparatus having a configuration where the friction member adheres to the support section that supports the medium, the cover section is easily replaced while preventing the friction member from being peeled off.

A method of attaching a cover section according to a ninth aspect of the invention, is a method of attaching a cover section, the method being performed with a medium support unit, the medium support unit being configured to support a medium on which printing is performed by a printing apparatus, the medium support unit including a support section including a support surface on which a medium is supported, and a cover section attached to the support section to cover the support surface. The cover section includes, on at least a part of a front side on which the medium is supported, a friction member having a static friction coefficient with respect to the medium, which is greater than a coefficient of static friction of the support surface, and on a back side opposite to the front side when the cover section is attached to the support section, a first area having a first adhesive force and a second area whose adhesive force is less than the first adhesive force. The method including attaching the cover section to the support section by adhering at least a part of the first area to the support section.

According to the present aspect, a medium support unit including, on the back side of the cover section, a first area having a first adhesive force and a second area whose adhesive force is less than the first adhesive force is used to adhere at least a part of the first area to the support section, and thus the cover section is attached to the support section. Thus, the first area whose adhesive force relatively strong prevents the friction member (the cover section provided with the friction member) from being peeled off, and by the second area whose adhesive force relatively weak, the friction member is peeled off from the support section, to facilitate the replacement of the friction member (the cover section provided with the friction member).

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus 1 according to an example of the invention will be described in detail with reference to the appended drawings.

Figure 1:
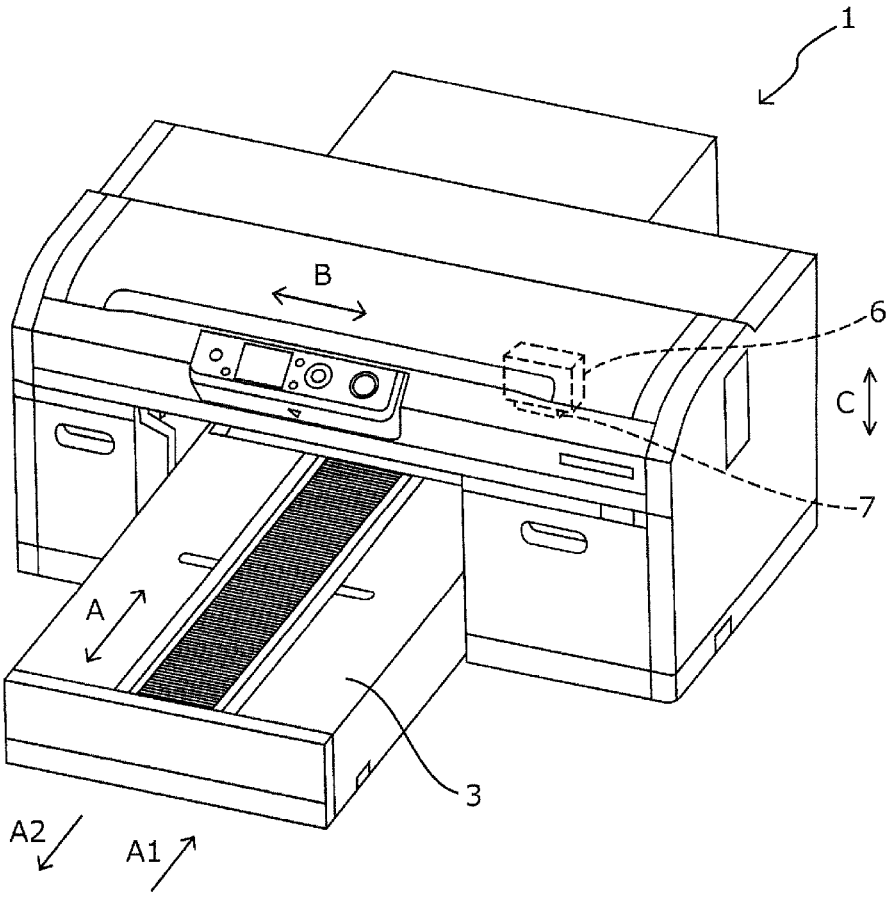
FIG. 1 is a schematic perspective view illustrating a printing apparatus according to an example of the invention.
Figure 2:
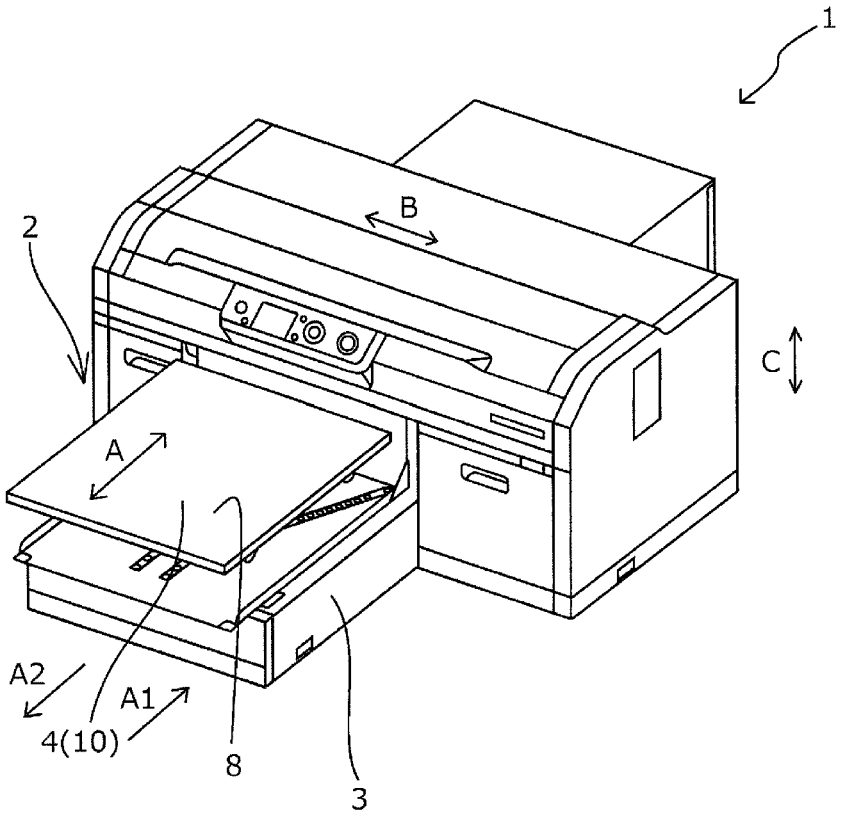
FIG. 2 is a schematic perspective view illustrating a printing apparatus according to an example of the invention.
Figure 3:
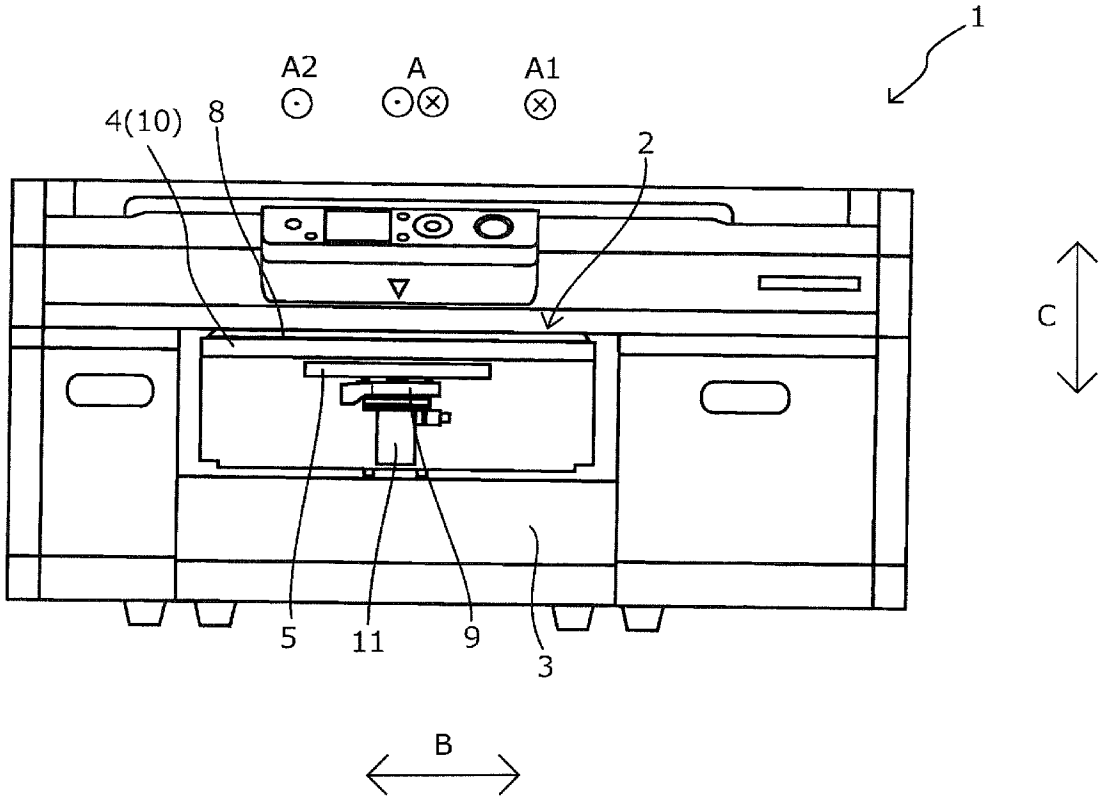
FIG. 3 is a schematic front view illustrating a printing apparatus according to an example of the invention.
Figure 4:
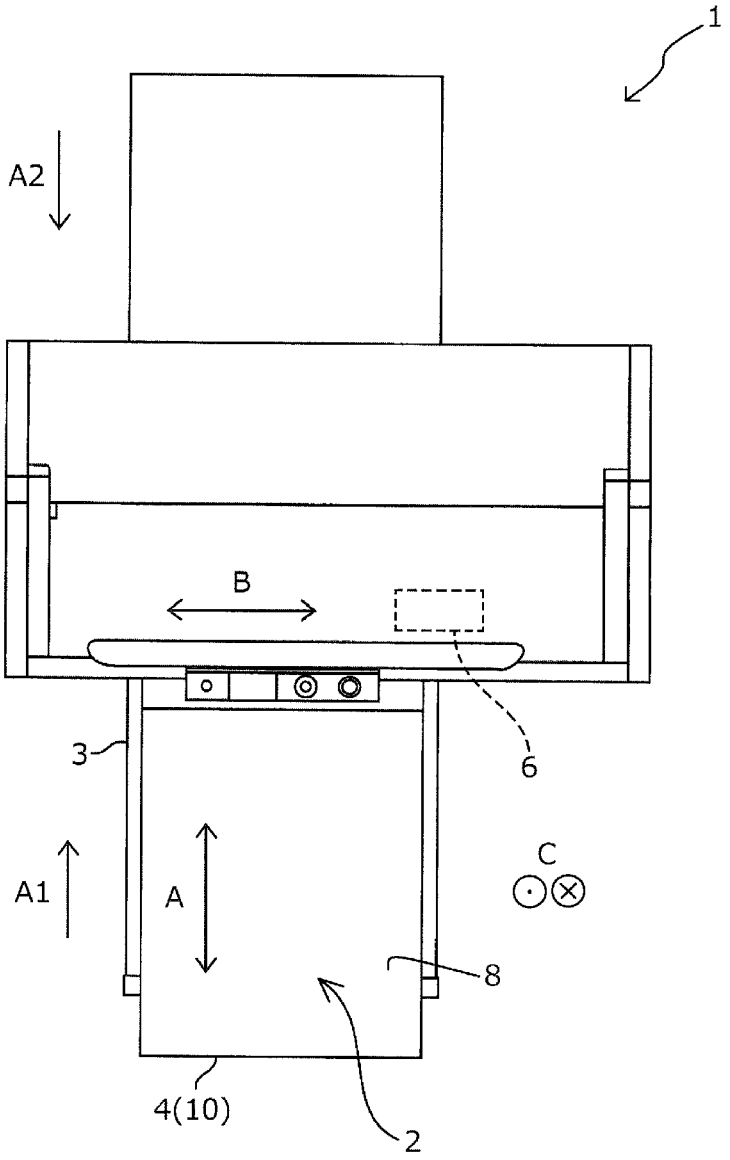
FIG. 4 is a schematic plan view illustrating a printing apparatus according to an example of the invention.

FIG. 1 is a schematic perspective view of a printing apparatus 1 according to the present example, illustrating a state in which a medium support unit 2 that is a support section is at a printing start position. FIG. 2 is a schematic perspective view of the printing apparatus 1 according to the present example, illustrating a state in which the medium support unit 2 is at a medium setting position. FIG. 3 is a schematic front view of the printing apparatus 1 according to the present example. FIG. 4 is a schematic plan view of the printing apparatus 1 according to the present example, illustrating a state in which the medium support unit 2 is at the medium setting position. Note that in all of FIG. 1 to FIG. 4, the components are illustrated in a simplified manner. Here, the printing start position is defined as the start position of the medium support unit 2 at the start of printing on the medium, and the set position is defined as the stop position of the medium support unit 2 where the medium is set on the medium support unit 2.

A printing apparatus 1 according to the present example includes a medium support unit 2. The medium support unit 2 includes a tray 4 that is a support section, and the tray 4 includes a support surface 8 on which the medium is supported. The medium support unit 2 supports the medium on the support surface 8 of the tray 4. The medium support unit 2 then moves the medium supported by the tray 4 together with the medium support unit 2 in a movement direction A. Note that, although details will be described later, in the printing apparatus 1 according to the present example, a cover section 10 including a fabric 12 (refer to FIG. 5 to FIG. 12) serving as a slip prevention member (a friction member) is attached to the tray 4 to firmly support the medium in the tray 4.

In addition, the printing apparatus 1 includes a medium transport unit 3 that transports the medium supported by the tray 4 in the movement direction A. The movement direction A is a direction including a direction A1, and a direction A2 opposite to the direction A1.

In addition, the tray 4 is detachably installed on a stage 5. Here, an attachment/detachment direction C of the tray 4 in relation to the stage 5 is a vertical direction for the printing apparatus 1 according to the present example. Rotating a lever 9 causes the tray 4 and the stage 5 to move in a direction (vertical direction) along the attachment/detachment direction C. Note that, as illustrated in FIG. 3, the lever 9 is provided on an arm section 11. A variety of materials can be used as the medium, including textiles (fabric, cloth, and the like), paper, vinyl chloride resin, and the like.

The printing apparatus 1 includes, in its interior, a print head 7 serving as a printing unit capable of performing printing (forming an image) on a medium by discharging ink that is an example of a liquid from a nozzle (not illustrated). The printing apparatus 1 according to the present example moves a carriage 6, which holds the print head 7, back and forth in a scanning direction B that intersects with the movement direction A. The printing apparatus 1 forms a desired image by discharging ink from the print head 7 onto a medium supported by the tray 4 while moving the print head 7 back and forth in the scanning direction B.

Note that in the printing apparatus 1 according to the present example, the front side (lower-left direction) in FIG. 1 corresponds to the medium setting position of the tray (refer to FIG. 2 and FIG. 4). The tray 4 on which the medium is set is moved in the direction A1 of the movement direction A until the tray 4 reaches a discharging start position, which corresponds to the rear side (upper-right direction) in FIG. 1. The printing is then performed while the tray 4 is moved in the direction A2 of the movement direction A.

The medium support unit 2 usable in the printing apparatus 1 according to the present example will be described next.

Figure 5:
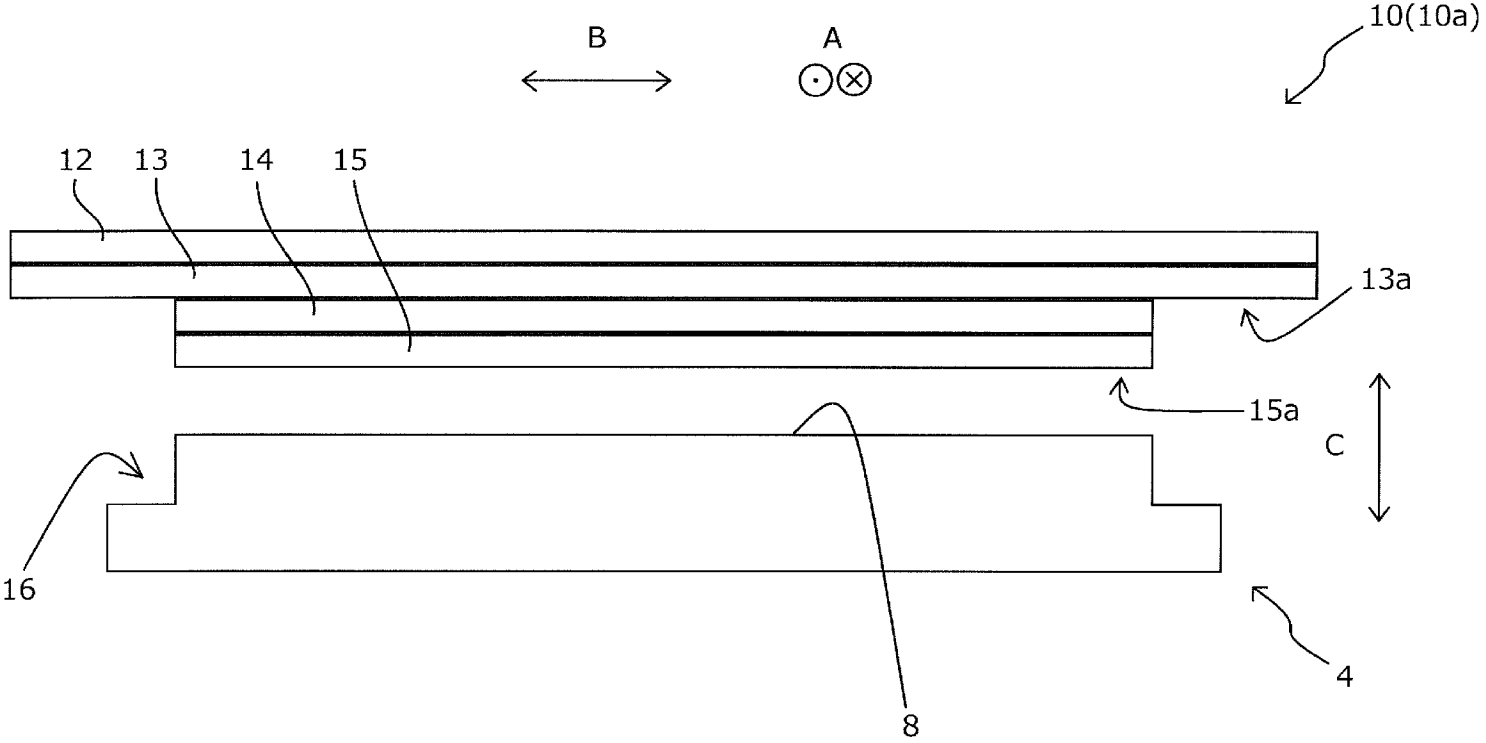
FIG. 5 is a schematic front view illustrating a medium support unit according to Example 1 usable in a printing apparatus according to an example of the invention.
Figure 6:
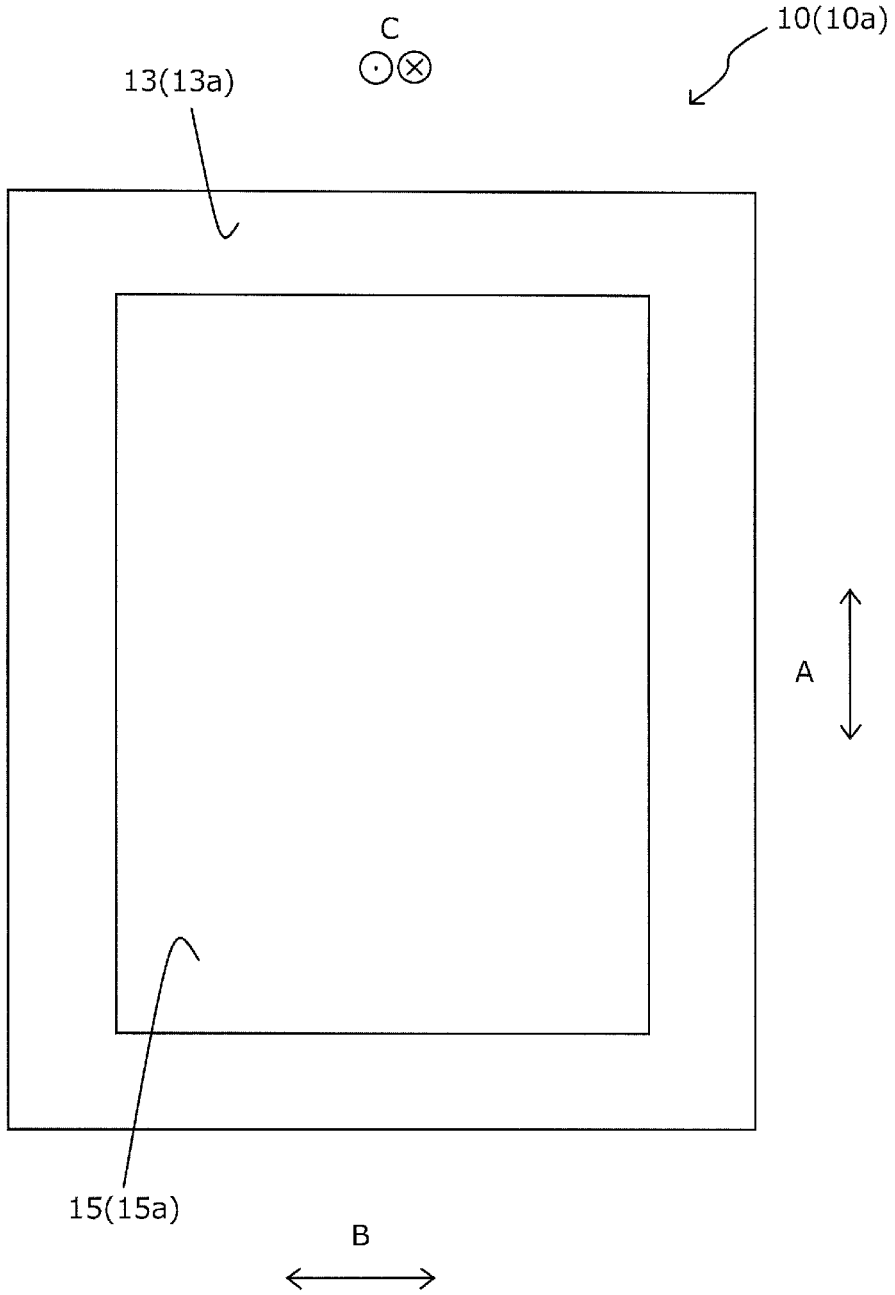
FIG. 6 is a schematic bottom view illustrating a medium support unit according to Example 1 usable in a printing apparatus according to an example of the invention.

Example 1 (FIG. 5 and FIG. 6)

Here, FIG. 5 is a schematic front view illustrating the cover section 10 (the cover section 10*a*) and the tray 4 that constitute the medium support unit 2 according to Example 1, representing the positional relationship when the cover section 10 is attached to the tray 4. FIG. 6 is a schematic bottom view illustrating the cover section 10 (the cover section 10*a*) that constitutes the medium support unit 2 of Example 1. Note that FIG. 5 and FIG. 6 are schematic diagrams representing composition ratios in the movement direction A, in the scanning direction B, and in the attachment/detachment direction C by dimensional ratios different from actual values.

As illustrated in FIG. 5, the cover section 10 according to the present example is constituted by, in order from the upper side (the side on which the medium is to be supported) to the lower side (the side to be placed on the tray 4) in the attachment/detachment direction C, the fabric 12 serving as a friction member having a static friction coefficient with respect to the medium, which is greater than a static friction coefficient of the support surface 8, a strong adhesive 13 having a strong adhesive force, a reinforcing member 14 that makes the cover section 10*a* according to the present example hard to deform, and a weak adhesive 15 having an adhesive force that is less than the adhesive force of the strong adhesive 13. Here, given that the adhesive force of the strong adhesive 13 is defined as a first adhesive force, the adhesive force of the weak adhesive 15 can be a second adhesive force that is less than the first adhesive force.

Note that the "adhesive force" represents the force at which a test piece is peeled off when the test piece adhered on a stainless-steel plate is pulled at 180 degrees or is pulled perpendicularly to the adhering surface, where (N/mm) is used as the unit. For example, when a force for peeling off a test piece having width of 10 mm is 10 N, the adhesive force is determined as 10 (N/10 mm).

As illustrated in FIG. 5, in the cover section 10*a*, the reinforcing member 14 and the weak adhesive 15 are formed only in areas corresponding to the support surface 8, and the fabric 12 and the strong adhesive 13 are formed on an area extending around a step portion 16, which is a peripheral part of the support surface 8, and a periphery of the step portion 16. As illustrated in FIG. 4, the tray 4 according to the present example includes a rectangular support surface 8 in a plan view. As illustrated in FIG. 6, the weak adhesive 15 (and the reinforcing member 14) is formed in a rectangular shape having a size and a shape that correspond to the support surface 8 having a rectangular shape in a bottom view. That is, the cover section 10*a* includes a first area 13*a* serving as a strong adhesive area and a second area 15*a* serving as a weak adhesive area. The first area 13*a* has a first adhesive force by including the strong adhesive 13. The second area 15*a* has a second adhesive force, which is less than the first adhesive force, by including the weak adhesive 15. The cover section 10*a* according to the present example thus formed is attached to the tray 4 to cover the support surface 8 such that the first area 13*a* serving as a strong adhesive area adheres to the step portion 16 and to a partial area of the back side of the tray 4 (the opposite side to the support surface 8), and the second area 15*a* serving as a weak adhesive area adheres to the support surface 8. At this time, due to the attachment of the cover section 10*a*, the support surface 8 indirectly supports the medium via the cover section 10 without directly supporting the medium. As such, the support surface 8 may support the medium indirectly. Note that in the cover section 10*a*, the side on which the medium is supported is defined as the front side, and the side opposite to the front side, which faces the tray 4 when the cover section 10*a* is attached to the tray 4, is defined as the back side.

Here, to summarize, the medium support unit 2 according to the present example is a medium support unit that supports a medium on which printing is performed by the printing apparatus 1. The medium support unit 2 includes the tray 4 including the support surface 8 that supports a medium, and the cover section 10*a* to be attached to the tray 4 to cover the support surface 8. The cover section 10*a* includes, on at least a part of the front side on which the medium is supported, a fabric 12 having a static friction coefficient with respect to the medium, which is greater than the coefficient of static friction of the support surface 8, and on the back side opposite to the side (the front side) for supporting the medium, which faces the tray 4 when the cover section 10*a* is attached to the tray 4, the first area 13*a* having a first adhesive force and the second area 15*a* whose adhesive force is less than the first adhesive force. Then, the cover section 10*a* is attached to the tray 4 by adhering at least a part of the first area 13*a* to the tray 4.

In this way, the medium support unit 2 according to the present example includes, on the back side of the cover section 10*a*, a first area 13*a* having a first adhesive force and a second area 15*a* whose adhesive force is less than the first adhesive force. Thus, the medium support unit 2 according to the present example is configured such that the first area 13*a* whose adhesive force relatively strong prevents the fabric 12 (the cover section 10*a* provided with the fabric 12)

from being peeled off, and by the second area 15*a* whose adhesive force relatively weak, the fabric 12 is peeled off from the tray 4, to facilitate the replacement of the fabric 12 (the cover section 10*a* provided with the fabric 12).

Note that, although the fabric 12 is used as the friction member in the present example, any member other than the fabric 12 may be used without particular limitation on a friction member.

Also note that there is no limitation on the adhesive force of the "first adhesive force" and the "second adhesive force", and the "first adhesive force" may be greater than the "second adhesive force".

The above-mentioned "second area 15*a* whose adhesive force relatively weak" represents that the adhesive force of the second area 15*a* is less than the adhesive force of the first area 13*a*, and the adhesive force of the second area 15*a* may be 0. For example, in the present example, the weak adhesive 15 may be eliminated and the second area 15*a* may be a non-adhesive area having no adhesive force (an area where the reinforcing member 14 is exposed). At this time, the reinforcing member 14 has no adhesive force by itself. That is, given that the adhesive force of the strong adhesive 13 is defined as the first adhesive force, the adhesive force of the reinforcing member 14 is less than the first adhesive force. Furthermore, given that the second area 15*a* is a non-adhesive area, the portion constituted by the strong adhesive 13 may be constituted by the weak adhesive 15. At this time, given that the adhesive force of the weak adhesive 15 is defined as the first adhesive force, the adhesive force of the reinforcing member 14 is less than the first adhesive force, and thus the adhesive force of the second area 15*a* is less than the first adhesive force.

As illustrated in FIG. 6, in the medium support unit 2 according to the present example, the second area 15*a* is disposed at the center portion of the back side of the cover section 10*a*, and the first area 13*a* is disposed outside of the center portion of the back side of the cover section 10*a*.

In this way, at least a part of the second area is disposed in the center portion of the back side of the cover section 10 and at least a part of the first area is disposed outside of the center portion of the back side of the cover section 10. Thus, for example, when positioning the support surface 8 to coincide with the position of the second area in attaching the cover section 10 to the tray 4, the positioning is made easy by making the cover section 10 easily peelable.

As described above, in the medium support unit 2 according to the present example, the second area 15*a* includes a weak adhesive area having a second adhesive force that is less than the first adhesive force.

According to the above aspect, the second area including at least the weak adhesive area prevents, by the second area in addition to the first area, the fabric 12 (the cover section provided with the fabric 12) from being peeled off, to effectively prevent peeling of the cover section 10.

As described above, in the medium support unit 2 according to the present example, the cover section 10*a* includes the reinforcing member 14 that makes the cover section 10*a* hard to deform. Thus, the medium support unit 2 according to the present example is configured to prevent the cover section 10 from losing its shape when being attached to/detached from the tray 4.

Note that the reinforcing member may be formed, insofar as having an effect of making the cover section 10 hard to deform by providing the reinforcing member, such that a material having rigidity (e.g., bending rigidity) that is greater than the rigidity of the friction member (the fabric 12) constituting the cover section 10 is attached to the cover section 10. Specifically, for example, resin, fabric, and the like can be used for the material. Although the position and the shape of the reinforcing member has no particular limitation, the reinforcing member may particularly be provided in the area opposite to the support surface 8 as in the present example.

Hereinafter, the medium support unit 2 of Example 2 will be described.

Figure 7:
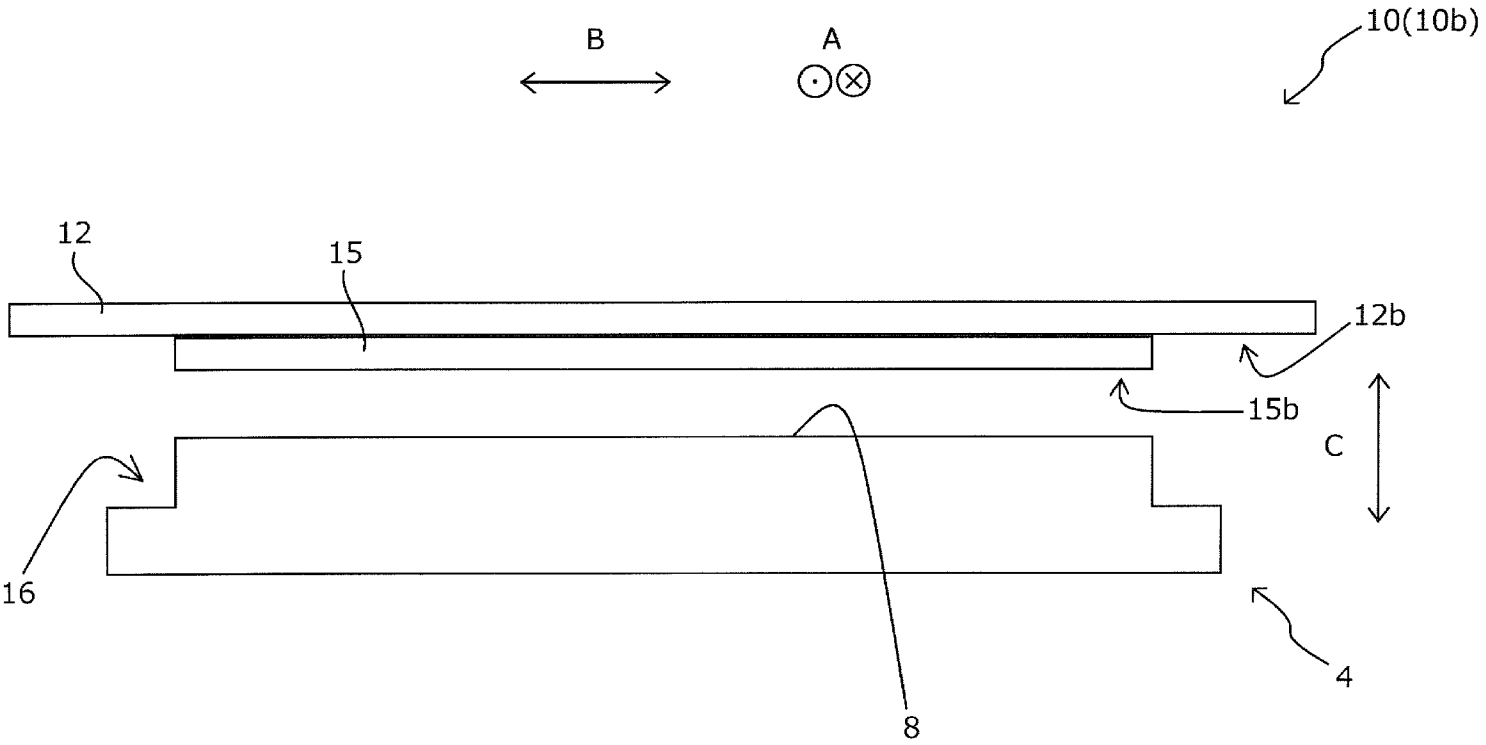
FIG. 7 is a schematic front view illustrating a medium support unit according to Example 2 usable in a printing apparatus according to an example of the invention.
Figure 8:
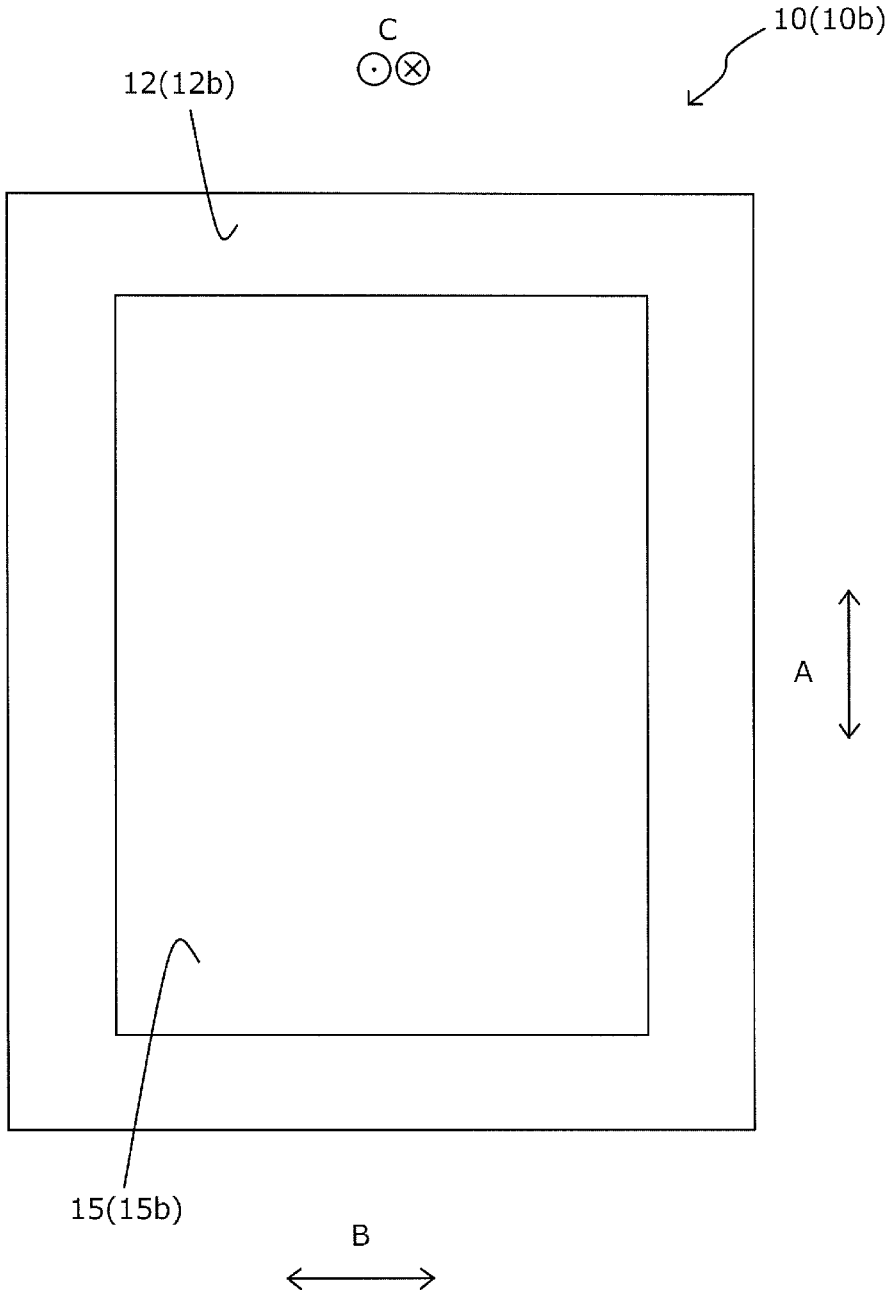
FIG. 8 is a schematic bottom view illustrating a medium support unit according to Example 2, usable in in a printing apparatus according to an example of the invention.

Example 2 (FIG. 7 and FIG. 8)

FIG. 7 is a schematic front view illustrating the cover section 10 (the cover section 10*b*) and the tray 4 constituting the medium support unit 2 of Example 2, representing the positional relationship when the cover section 10 is attached to the tray 4, which corresponds to FIG. 5 illustrating the medium support unit 2 of Example 1. FIG. 8 is a schematic bottom view illustrating the cover section 10 (the cover section 10*b*) that constitutes the medium support unit 2 of Example 2, which corresponds to FIG. 6 illustrating the medium support unit 2 of Example 1. Note that FIG. 7 and FIG. 8 are schematic diagrams, as are FIG. 5 and FIG. 6, representing the composition ratios in the movement direction A, in the scanning direction B, and in the attachment/detachment direction C by dimensional ratios different from the actual values. Also note that the components common to Example 1 are denoted by identical reference numbers, and the detailed description of the components will be omitted.

Note that the medium support unit 2 according to the present example is a medium support unit usable in the printing apparatus 1, as is the case with the medium support unit 2 of Example 1.

As illustrated in FIG. 7, the cover section 10 according to the present example is constituted by, in order from the upper side to the lower side in the attachment/detachment direction C, the fabric 12, and the weak adhesive 15 having weak adhesive force. At this time, the fabric 12 does not have adhesive force by itself. That is, given that the adhesive force of the weak adhesive 15 is defined as the first adhesive force, the adhesive force of the fabric 12 is less than the first adhesive force.

As illustrated in FIG. 7, the weak adhesive 15 is formed only on the area corresponding to the support surface 8, and the fabric 12 is formed on the area extending around the step portion 16, which is the peripheral part of the support surface 8, and the periphery of the step portion 16. As illustrated in FIG. 4, the tray 4 according to the present example includes a rectangular support surface 8 in a plan view, and as illustrated in FIG. 8, the weak adhesive 15 is formed in a rectangular shape having a size and a shape corresponding to the support surface 8 having a rectangular shape in a bottom view. The cover section 10*b* according to the present example thus formed is attached to the tray 4 to cover the support surface 8 such that a first area 15*b* serving as the adhesive area adheres to the support surface 8, and a second area 12*b* serving as the non-adhesive area protrudes to the outside of the support surface 8 (to the step portion 16 side).

Here, to summarize, the medium support unit 2 according to the present example is a medium support unit that supports a medium on which printing is performed by the printing apparatus 1, which includes the tray 4 including the support surface 8 that supports a medium, and the cover section 10*b* to be attached to the tray 4 to cover the support surface 8. The cover section 10*b* includes, on at least a part of the front side, the fabric 12 that is a member having a static friction coefficient with respect to the medium, which is greater than the static friction coefficient of the support surface 8, and on the back side, the first area 15*b* having a first adhesive force and the second area 12*b* whose adhesive force is less than the first adhesive force. Specifically, the second area 12*b* is non-adhesive area having no adhesive force. The second area 12*b* is formed such that a part of at least the first area 15*b* adheres to the tray 4 and thus the cover section 10*b* is attached to the tray 4.

In this way, the medium support unit 2 according to the present example includes, on the back side of the cover section 10*b*, the first area 15*b* having a first adhesive force and the second area 12*b* having no adhesive force. Thus, the medium support unit 2 of the present example is configured such that the first area 15*b* whose adhesive force relatively strong prevents the fabric 12 (the cover section 10*b* provided with the fabric 12) from being peeled off, and by the second area 12*b* whose adhesive force relatively weak, the fabric 12 is peeled off from the tray 4, to facilitate the replacement of the fabric 12 (the cover section 10*b* provided with the fabric 12).

Note that, in the present example, the portion constituted by the weak adhesive 15 may be constituted by the strong adhesive 13. At this time, given that the adhesive force of the weak adhesive 13 is defined as the first adhesive force, the adhesive force of the fabric 12 is less than the first adhesive force, and thus the adhesive force of the second area 12*b* is less than the first adhesive force.

As illustrated in FIG. 8, in the medium support unit 2 according to the present example, the first area 15*b* is disposed at the center portion of the back side of the cover section 10*b*, and the second area 12*b* is disposed outside of the center portion of the back side of the cover section 10*b*.

In this way, at least a part of the second area is disposed in the center portion of the back side of the cover section 10, and at least a part of the first area is disposed outside of the center portion of the back side of the cover section 10. Thus, for example, the fabric 12 (the cover section 10*b* provided with the fabric 12) is peeled off from the tray 4 from an outer portion, corresponding to the second area, as the starting point, to particularly facilitate the replacement of the cover section 10.

As described above, in the medium support unit 2 according to the present example, the second area 12*b* includes a non-adhesive area having no adhesive force.

In this way, the second area includes at least the weak adhesive area. Thus, the fabric 12 (the cover section 10*b* provided with the fabric 12) is particularly easily peeled off from the tray 4 by means of the second area, to particularly facilitate the replacement of the cover section 10.

Hereinafter, the medium support unit 2 of Example 3 will be described.

Figure 9:
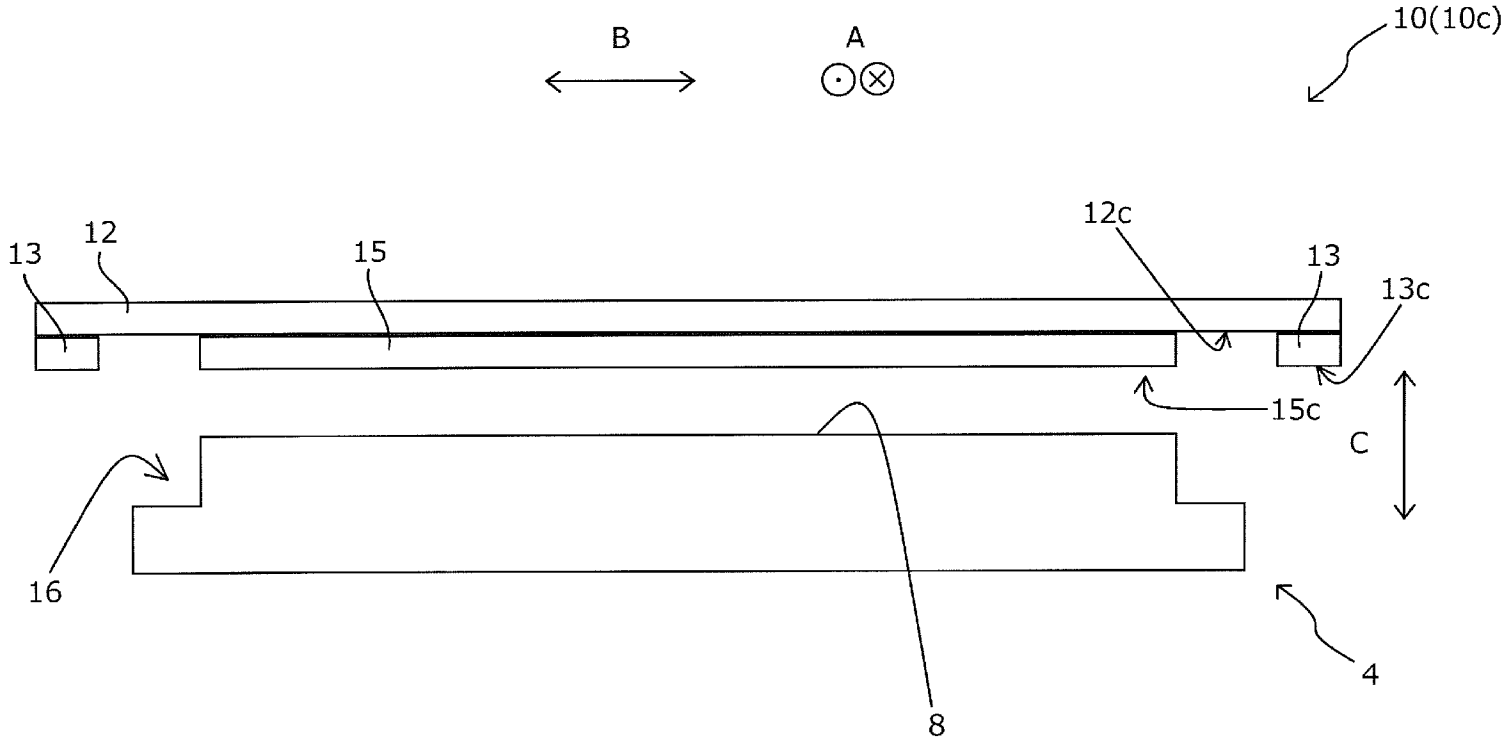
FIG. 9 is a schematic front view illustrating a medium support unit according to Example 3 usable in a printing apparatus according to an example of the invention.
Figure 10:
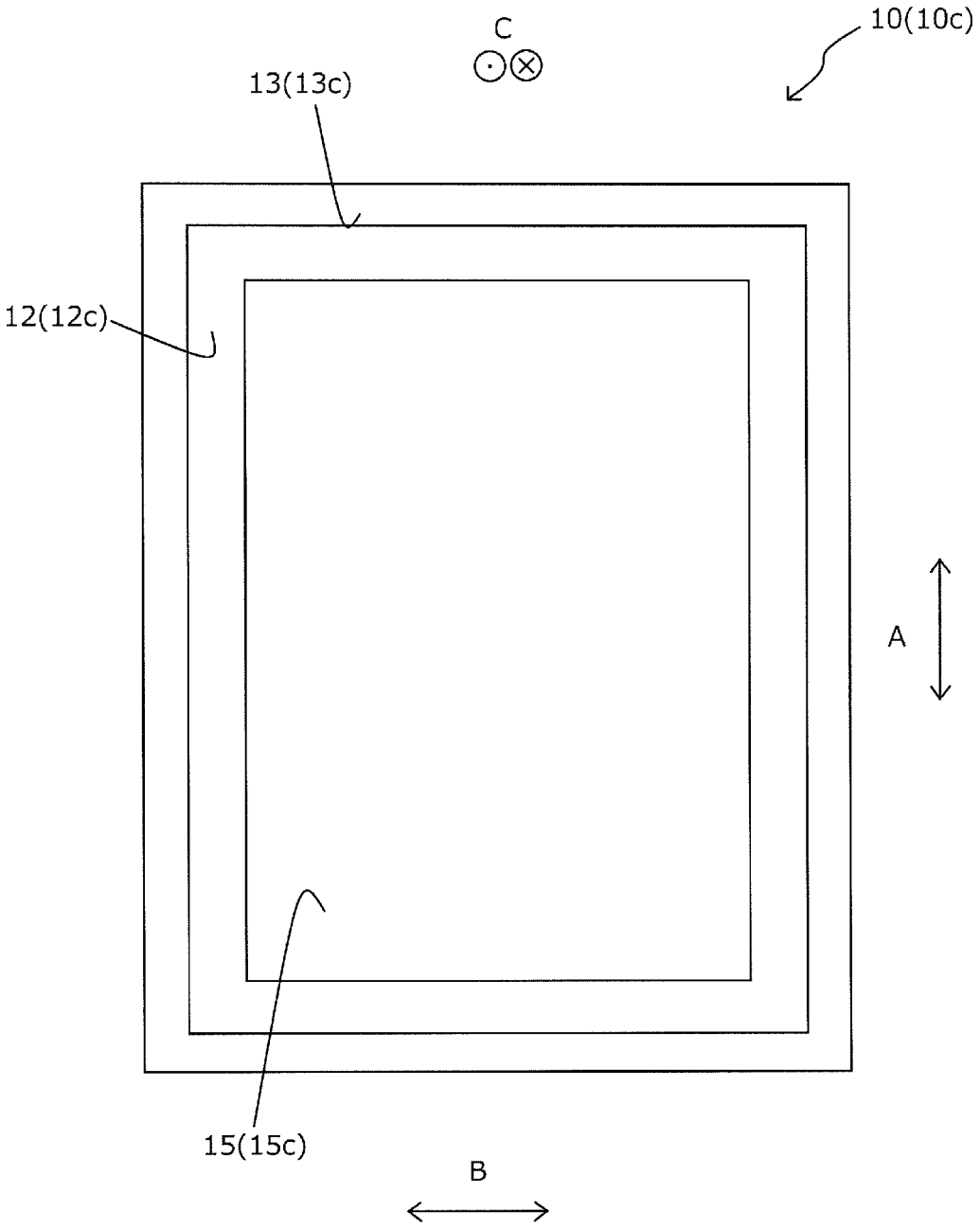
FIG. 10 is a schematic bottom view illustrating a medium support unit according to Example 3 usable in a printing apparatus according to an example of the invention.

Example 3 (FIG. 9 and FIG. 10)

FIG. 9 is a schematic front view illustrating the cover section 10 (the cover section 10*c*) and the tray 4 constituting the medium support unit 2 of Example 3, representing the positional relationship when the cover section 10 is attached to the tray 4, which corresponds to FIG. 5 illustrating the medium support unit 2 of Example 1. FIG. 10 is a schematic bottom view illustrating the cover section 10 (the cover section 10*c*) that constitutes the medium support unit 2 of Example 3, which corresponds to FIG. 6 illustrating the medium support unit 2 of Example 1. Note that FIG. 9 and FIG. 10 are schematic diagrams, as are FIG. 5 and FIG. 6, representing the composition ratios in the movement direction A, in the scanning direction B, and in the attachment/detachment direction C by dimensional ratios different from the actual values. Also note that the components common to Example 1 and Example 2 are denoted by identical reference numbers, and the detailed description of the components will be omitted.

Note that the medium support unit 2 according to the present example is a medium support unit usable in the printing apparatus 1, as is the case with the medium support units 2 of Example 1 and Example 2.

As illustrated in FIG. 9, the cover section 10 according to the present example is constituted by, in order from the upper side to the lower side in the attachment/detachment direction C, the fabric 12, the weak adhesive 15 (the center portion) having weak adhesive force, and the strong adhesive 13 (the peripheral portion) having strong adhesive force.

In addition, as illustrated in FIG. 9, the weak adhesive 15 is formed only in the area corresponding to the support surface 8, and the fabric 12 is formed on the area extending around the step portion 16, which is the peripheral part of the support surface 8, and the periphery of the step portion 16. As illustrated in FIG. 10, the strong adhesive 13 is formed in the area surrounding the fabric 12. As illustrated in FIG. 4, the tray 4 according to the present example includes a rectangular support surface 8 in a plan view, and as illustrated in FIG. 10, the weak adhesive 15 is formed in a rectangular shape having a size and a shape corresponding to the support surface 8 having a rectangular shape in a bottom view. The cover section 10*c* according to the present example thus formed is attached to the tray 4 to cover the support surface 8 such that a first area 13*c* serving as a strong adhesive area is formed on a part of the step portion 16 and a partial area of the back side of the tray 4 (the opposite side to the support surface 8), and the second area 15*c* serving as a weak adhesive area adheres to the support surface 8.

As illustrated in FIG. 10, the medium support unit 2 according to the present example includes a second area 12*c* as a non-adhesive area between the second area 15*c* and the first area 13*c*. The medium support unit 2 is thus formed such that even when the cover section 10*c* is attached to the tray 4, a space is formed between the second area 12*c* and the step portion 16. Thus, the medium support unit 2 according to the present example is formed such that a notch made at the space with a cutter knife and the like when replacing the cover section 10*c* enables the cover section 10*c* to easily detach from the tray 4, from the notch as the starting point.

As in the present example, the "second area whose adhesive force is less than the first adhesive force" may be formed to include both a weak adhesive area (the second area 15*c*) having a second adhesive force that is less than the first adhesive force and a non-adhesive area (the second area 12*c*) having no adhesive force.

Hereinafter, the medium support unit 2 of Example 4 will be described.

Figure 11:
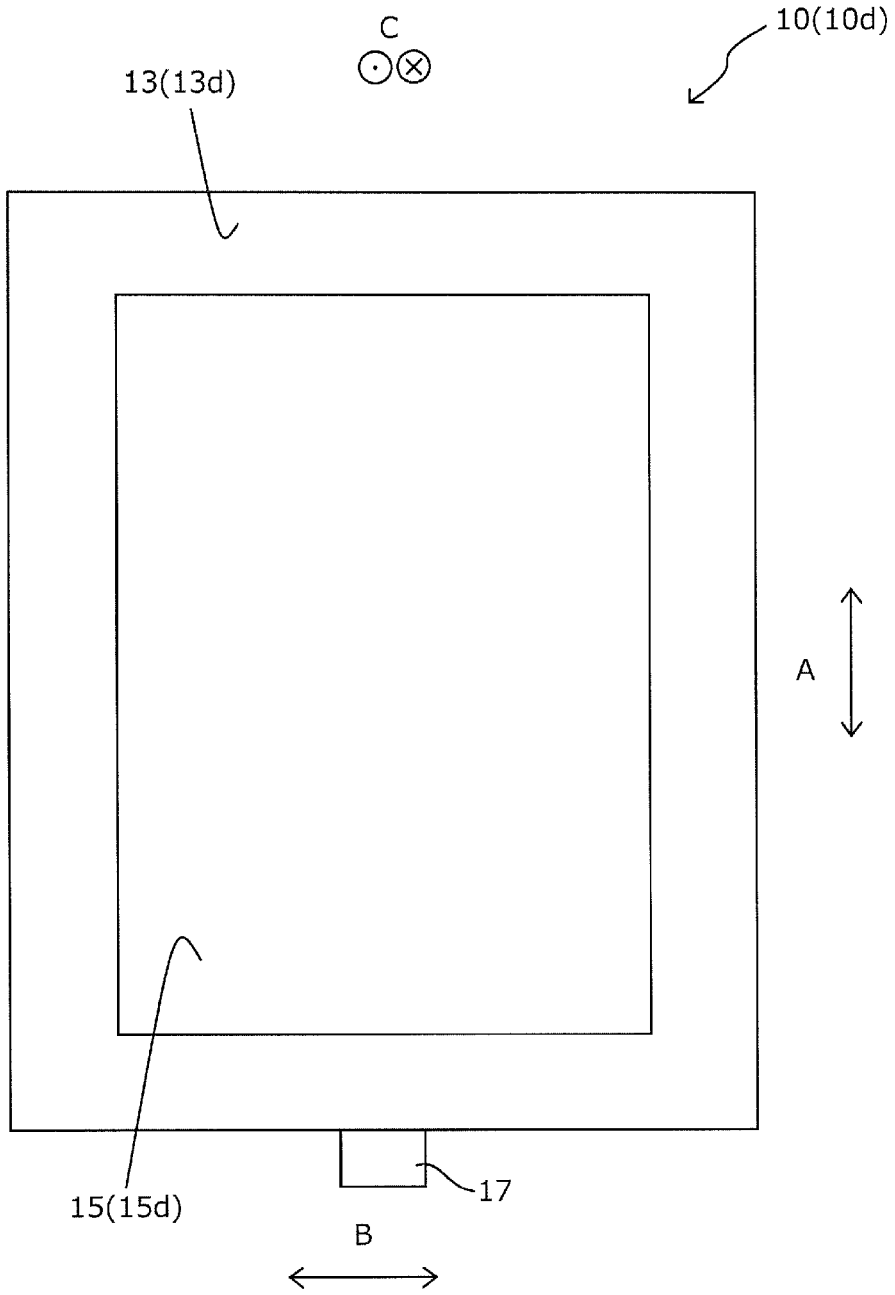
FIG. 11 is a schematic bottom view illustrating a medium support unit according to Example 4 usable in a printing apparatus according to an example of the invention.

Example 4 (FIG. 11)

FIG. 11 is a schematic bottom view illustrating the cover section 10 (the cover section 10*d*) that constitutes the medium support unit 2 of Example 4, which corresponds to FIG. 6 illustrating the medium support unit 2 of Example 1. Note that FIG. 11 is a schematic diagram, as is FIG. 6, representing the composition ratios in the movement direction A, in the scanning direction B, and in the attachment/detachment direction C by dimensional ratios different from the actual values. Also note that the components common to Example 1 to Example 3 are denoted by identical reference numbers, and the detailed description of the components will be omitted.

Note that the medium support unit 2 according to the present example is a medium support unit usable in the printing apparatus 1, as is the case with the medium support units 2 of Example 1 to Example 3.

As illustrated in FIG. 11, the cover section 10*d* according to the present example has a configuration identical to the cover section 10*a* of Example 1 except that a handle section 17 is provided at a part of the peripheral portion of the cover section 10*d*.

Specifically, the cover section 10*d* according to the present example includes the handle section 17 at a portion located outside of the support surface 8 when the cover section 10*d* is attached to the tray 4. The "portion located outside of the support surface 8" represents a portion that comes out of the surface area of the upper surface of the support surface 8 when the cover section 10*d* is attached to the tray 4, and the handle section 17 may be provided in this portion. For example, even when the handle section 17 wraps around the back side of the support surface 8, the handle section 17 is regarded as being provided at the "portion located outside of the support surface 8" by folding back the peripheral portion of the cover section 10*d* to the back side of the tray 4. According to this configuration, the medium support unit 2 of the present example particularly facilitates, when the fabric 12 (the cover section 10*d* provided with the fabric 12) is replaced, the replacement of the cover section 10*d* by holding the handle section 17 with fingertips.

Note that the handle section has no particular limitation on its disposal, shape, size, and material.

Hereinafter, the medium support unit 2 of Example 5 will be described.

Figure 12:
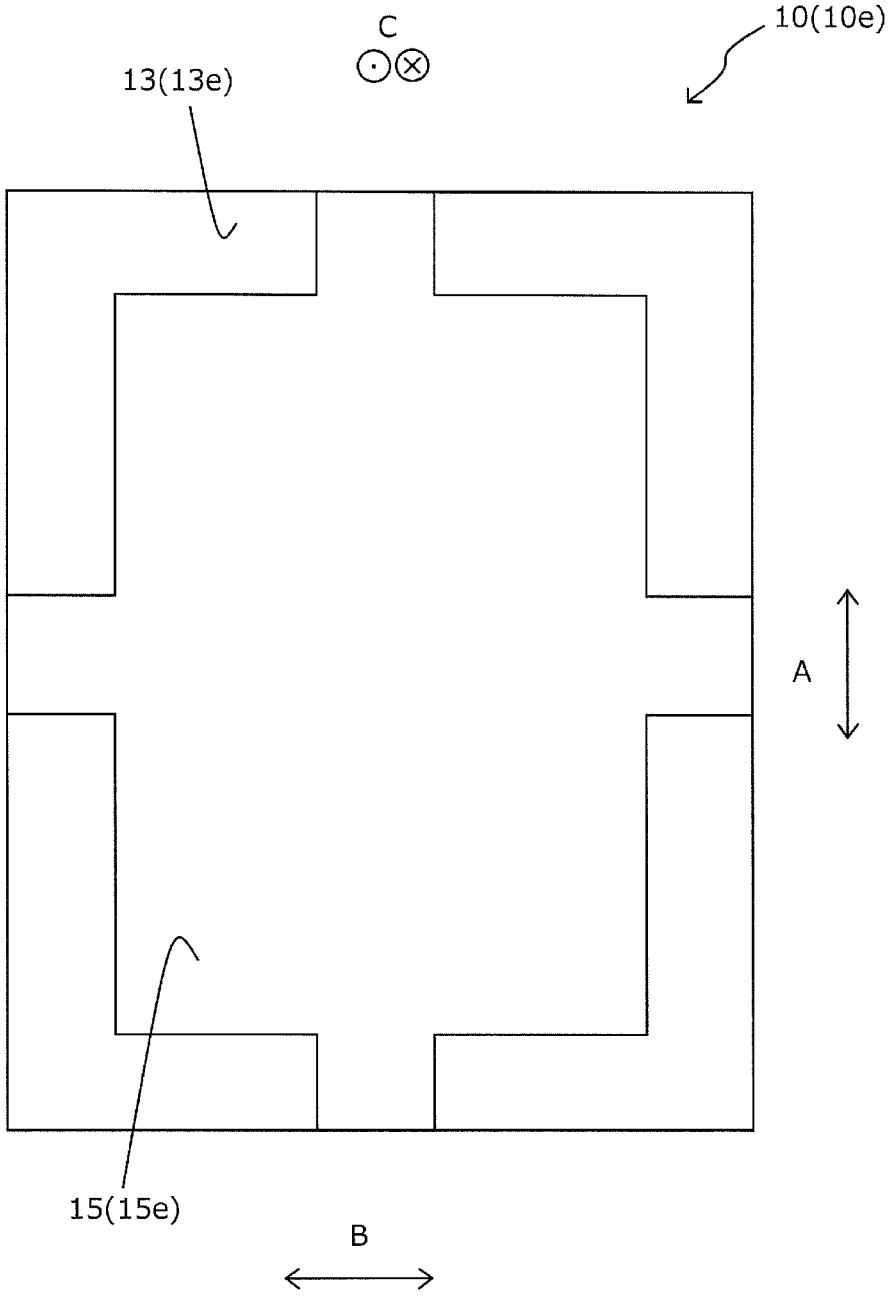
FIG. 12 is a schematic bottom view illustrating a medium support unit according to Example 5 usable in a printing apparatus according to an example of the invention.

Example 5 (FIG. 12)

FIG. 12 is a schematic bottom view illustrating the cover section 10 (the cover section 10*e*) that constitutes the medium support unit 2 of Example 3, which corresponds to FIG. 6 illustrating the medium support unit 2 of Example 1. Note that FIG. 12 is a schematic view, as is FIG. 6, representing composition ratios in the movement direction A, in the scanning direction B, and in the attachment/detachment direction C by dimensional ratios different from the actual values. Also note that the components common to Example 1 to Example 4 are denoted by identical reference numbers, and the detailed description thereof will be omitted.

Note that the medium support unit 2 according to the present example is a medium support unit usable in the printing apparatus 1, as is the case with the medium support units 2 of Example 1 to Example 4.

As illustrated in FIG. 12, a cover section 10*e* according to the present example includes the weak adhesive 15 (the second area 15*e*) on a part of the peripheral portion of the cover section 10*e* in addition to the area corresponding to the support surface 8. In other words, the cover section 10*e* according to the present example includes the strong adhesive 13 (the first area 13*e*) formed only in the corner portions on the peripheral portion of the cover section 10*e*.

As described above in Example 1 to Example 5, the first area and the second area may be disposed in various patterns, which are not limited only to the examples. For example, the second area may be formed only with a weak adhesive area such as in the cover section 10*a*, the cover section 10*d*, and the cover section 10*e*, only with a non-adhesive area such as in the cover section 10*b*, and with a combination of a weak adhesive area and a non-adhesive area such as in the cover section 10*c*.

Here, to summarize based on the printing apparatus 1, the printing apparatus 1, which includes the medium support unit 2 of any one of Example 1 to Example 5 and the print head 7 for performing printing on a medium supported by the medium support unit 2, facilitates the replacement of the cover section 10 while preventing the fabric 12 (the cover section 10 provided with the fabric 12) from being peeled off.

To summarize from another viewpoint, the medium support unit 2 configured to support a medium on which printing is performed by the printing apparatus 1 includes the tray 4 including the support surface 8 on which the medium is supported, and the cover section 10 to be attached to the tray 4 to cover the support surface 8. The cover section 10 includes, on at least a part of the front side, the fabric 12 having a static friction coefficient with respect to the medium, which is greater than the static friction coefficient of the support surface 8, and on the back side, the first area having a first adhesive force and the second area whose adhesive force is less than the first adhesive force. The medium support unit 2 is used to perform a method of attaching the cover section 10, the method including attaching the cover section 10 to the tray 4 by adhering at least a part of the first area to the tray 4.

Such a method of attaching the cover section is performed to prevent the fabric 12 (the cover section 10 provided with the fabric 12) from being peeled off by the first area, and to facilitate the replacement of the fabric (the cover section 10 provided with the fabric 12) by peeling off the fabric 12 from the tray 4 by the second area.

Note that the invention is not limited to the above-described examples, and various modifications are possible within the scope of the invention described in the claims, and it is needless to say that they are also included within the scope of the invention.

This application claims priority under 35 U.S.C. § 119 to Japanese Patent Application No. 2017-197715, filed Oct. 11, 2017. The entire disclosure of Japanese Patent Application No. 2017-197715 is hereby incorporated herein by reference.

What is claimed is:

1. A medium support unit configured to support a medium on which printing is performed by a printing apparatus, the medium support unit comprising:

a support section including a support surface configured to support a medium; and a cover section attached to the support section to cover the support surface, wherein the support section includes a step portion which is a peripheral part of the support surface, the step portion forming a recess at an edge of the support surface, the cover section includes, on at least a part of a front side on which the medium is supported, a friction member having a static friction coefficient with respect to the medium, which is greater than a static friction coefficient of the support surface, the cover section includes, on a back side opposite to the front side, which faces the support section when the cover section is attached to the support section, a first area having a first adhesive force and a second area whose adhesive force is less than the first adhesive force, and the cover section is attached to the support section by adhering at least a part of the first area to the support section, and the first area is extended to an area facing the step portion in a state where the cover section is attached to the support section.

2. The medium support unit according to claim 1, wherein at least a part of the second area is disposed in a center portion of the back side of the cover section, and at least a part of the first area is disposed outside of the center portion of the back side of the cover section.

3. The medium support unit according to claim 1, wherein at least a part of the first area is disposed in a center portion of the back side of the cover section, and at least a part of the second area is disposed outside of the center portion of the back side of the cover section.

4. The medium support unit according to claim 1, wherein the second area includes at least a weak adhesive area having a second adhesive force that is less than the first adhesive force.

5. The medium support unit according to claim 1, wherein the second area includes at least a non-adhesive area having no adhesive force.

6. The medium support unit according to claim 1, wherein the cover section includes a reinforcing member that makes the cover section hard to deform.

7. The medium support unit according to claim 1, wherein the cover section includes a handle section provided at a portion located outside of the support surface in a case where the cover section is attached to the support section.

8. A printing apparatus comprising:

the medium support unit according to claim 1; and a printing unit configured to perform printing on the medium supported by the medium support unit.

9. A method of attaching a cover section, the method being performed with a medium support unit, the medium support unit being configured to support a medium on which printing is performed by a printing apparatus, the medium support unit comprising:

a support section including a support surface configured to support a medium; and a cover section attached to the support section to cover the support surface, wherein the support section includes a step portion which is a peripheral part of the support surface, the step portion forming a recess at an edge of the support surface, the cover section includes, on at least a part of a front side on which the medium is supported, a friction member having a static friction coefficient with respect to the medium, which is greater than a static friction coefficient of the support surface, the cover section includes, on a back side opposite to the front side, which faces the support section when the cover section is attached to the support section, a first area having a first adhesive force and a second area having whose adhesive force is less than the first adhesive force, the first area is extended to an area facing the step portion in a state where the cover section is attached to the support section, the method comprising:

attaching the cover section to the support section by adhering at least a part of the first area to the support section.

10. A medium support unit configured to support a medium on which printing is performed by a printing apparatus, the medium support unit comprising:

a support section including a support surface configured to support a medium; and a cover section attached to the support section to cover the support surface, wherein:

the cover section includes a reinforcing member and a friction member, the friction member having a static friction coefficient with respect to the medium, which is greater than a static friction coefficient of the support surface, the reinforcing member has a front side and a back side, the front side has a first area having a first adhesive force, the front side is configured to be attached to the friction member via the first area, the back side has a second area having a second adhesive force, the second adhesive force is less than the first adhesive force, and the back side is configured to be attached to the support section via the second area.

* * * * *